United States Patent [19]

Jorgensen

[11] Patent Number: 4,834,012

[45] Date of Patent: May 30, 1989

[54] TILLER EXTENSION HINGE

[76] Inventor: Helge D. Jørgensen, 4, Schonbergsgade, DK-1906 Copenhagen V, Denmark

[21] Appl. No.: 122,541

[22] Filed: Nov. 12, 1987

Related U.S. Application Data

[63] Continuation of Ser. No. 916,516, Sep. 15, 1986, abandoned.

[30] Foreign Application Priority Data

Jan. 17, 1985 [DK] Denmark ..... 234/85

[51] Int. Cl.[4] ..... B63H 25/06

[52] U.S. Cl. ..... 114/162; 114/144 R

[58] Field of Search ..... 114/144 R, 162, 163, 114/165, 146; 440/6, 7, 63; 74/480 B, 544; 403/57, 58

[56] References Cited

U.S. PATENT DOCUMENTS

| | | | |
|---|---|---|---|
| 1,263,783 | 4/1918 | Maier | 403/58 |
| 2,603,981 | 7/1952 | Snyder | 440/63 |
| 2,992,623 | 7/1961 | Heckel, Jr. | 114/165 |
| 3,750,621 | 8/1973 | Hoyt | 440/63 |
| 3,810,440 | 5/1974 | Johnson, Jr. | 114/144 R |
| 4,228,756 | 10/1980 | Storer, Jr. | 114/144 R |
| 4,262,619 | 4/1981 | Hine | 114/144 R |
| 4,656,960 | 4/1987 | Davenport | 114/144 R |

*Primary Examiner*—Joseph F. Peters, Jr.
*Assistant Examiner*—Edwin L. Swinehart
*Attorney, Agent, or Firm*—Dressler, Goldsmith, Shore, Sutker & Milnamow, Ltd.

[57] ABSTRACT

A tiller extension hinge comprising two axes of rotation (6 and 8) at right angles or substantially at right angles to each other, one (8) supporting the tiller extension (1) and the other (6) having a permanent position relative to the tiller (4) and having an orientation considerably deviating from vertical, i.e. being substantially horizontal. If required, the axis (6) may be placed entirely in a horizontal plane and, if required, in a vertical plane through the tiller (4). The orientation of the axes of rotation will ensure that the tiller extension hinge does not unintentionally block the movement of the tiller extension (1) and that the position of the tiller (4) may be adjusted without difficulty in cases as well, when the tiller (1) is situated in or nearly in continuation of the tiller (4).

8 Claims, 1 Drawing Sheet

TILLER EXTENSION HINGE

This application is a continuation of application Ser. No. 916,516, filed Sept. 15, 1986, now abandoned.

The invention relates to a tiller extension hinge creating a movable connection between a tiller and a tiller extension and being formed as a double hinge having two axes in principle at right angles to each other, one of which is stationary relative to the tiller, and the other supports the tiller extension.

When steering boats—especially small motor and sailing boats—by tiller, it is often convenient to the helmsman to place himself somewhere else than in close proximity to the tiller as this will enable him to get a better survey or to contribute to preserving the stability and trim of the boat.

To obtain this, a tiller extension is used which in principle is a push and pull rod connected to the tiller by means of a hinge.

In a previously known type, this hinge consisted only of a bolt or screw extending vertically through a hole in an extension pin down into the tiller. This allowed the extension to move freely in the horizontal plane and, owing to the tolerance between hole and screw, to a certain limited degree in vertical direction as well.

Some newer, known constructions of this hinge still consist of a vertical axis of rotation—either in the shape of a pin inserted in the tiller or in the form of a rotatable connection between two pieces of metal one of which is mounted on top of the tiller—in which constructions, however, the extension is furthermore rotatable about an axis at right angles to the first axis which allows the extension to move freely in a vertical plane as well, downward limited by the tiller.

Figure 1:
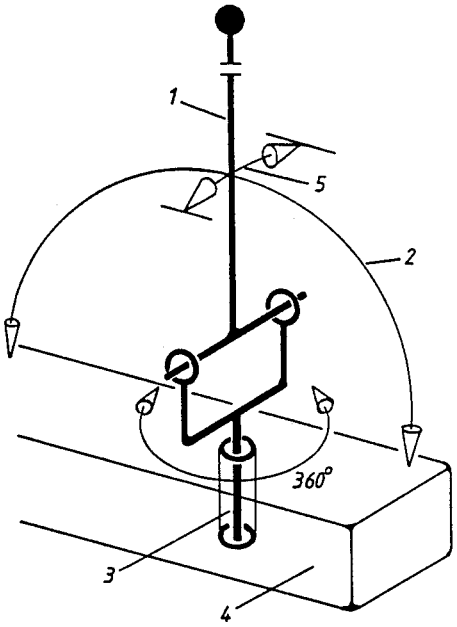
Fig. 1 PRIOR ART
FIG. 1 shows a prior art tiller extension hinge.

This known hinge is illustrated in FIG. 1 of the enclosed drawing, which shows a tiller extension hinge 1 which moves freely in a vertical plane 2 which is freely rotatable-360° about a vertical axis 3 in firm connection with the tiller 4.

In principle, this arrangement is working excellently when the helmsman is steering from a position at right angles opposite the tiller 4. An extremely unpleasant situation may arise, however, when during a manoeuvre the helmsman for some reason happens to place the tiller extension 1 in vertical or nearly vertical position so that the tiller extension 1 and the vertical axis 3 will be situated in continuation of each other. Without looking at the tiller extension hinge, he cannot know in which direction the vertical plane of movement 2 is oriented and, consequently, he will often try to lay the tiller extension 1 down at right angles to this plane, as shown by the arrow 5, and the tiller extension hinge will then block the movement. This has a tendency to happen during manoeuvres in harbours or in other pressed situations, and it often results in that the helmsman loses control of the boat or that the tiller extension 1 or the tiller extension hinge will break.

Another inconvenience arises when for some reason the helmsman moves forwards in the boat so that the tiller extension 1 forms only a small angle with the axis of the tiller 4, as in this situation he will be able to control the tiller 4 and consequently the boat, only by activating the tiller extension 1 with a bending moment which is rather inaccurate and very wearing to the helmsman's wrist.

It is the object of the invention to provide a tiller extension hinge which does not possess these disadvantages.

This is obtained by the tiller extension hinge according to the invention being characteristic in that the axis firmly positioned relative to the tiller extends in a direction considerably deviating from vertical direction, thereby bringing the critical position of the tiller extension, where a blocking may take place, out of the normal working field of the tiller extension. By choosing an appropriate orientation of this axis it becomes possible to ensure that the critical position of the tiller extension is in a place where it is to the least possible inconvenience to the helmsman.

Moreover, a suitable construction of the tiller extension hinge will ensure that the helmsman will be capable of keeping a firm control of the boat from a position in the front of the boat.

Figure 2:
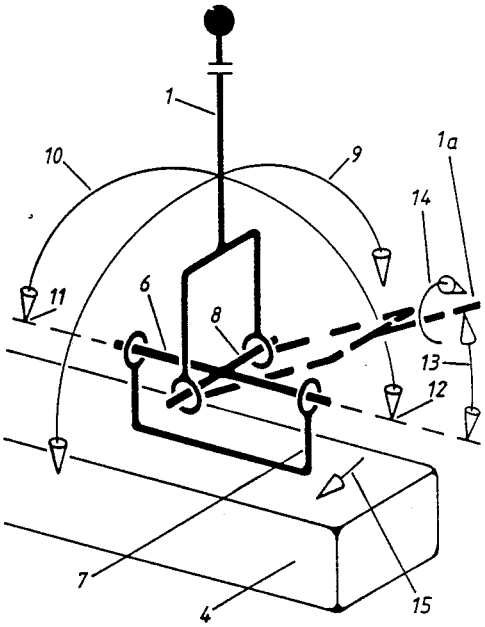
FIG. 2 shows a first embodiment of the present invention.
Figure 3:
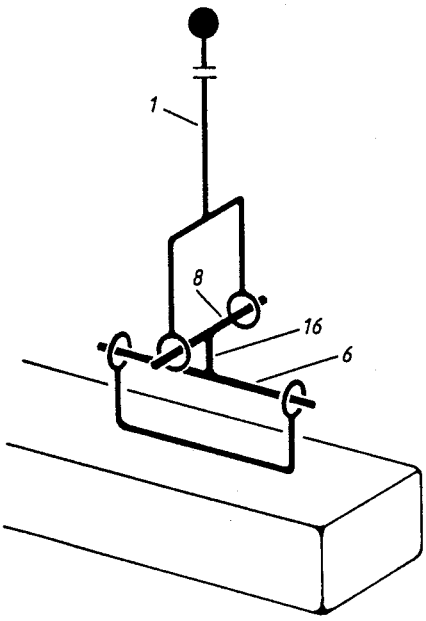
FIG. 3 shows a second embodiment of the present invention.
Figure 4:
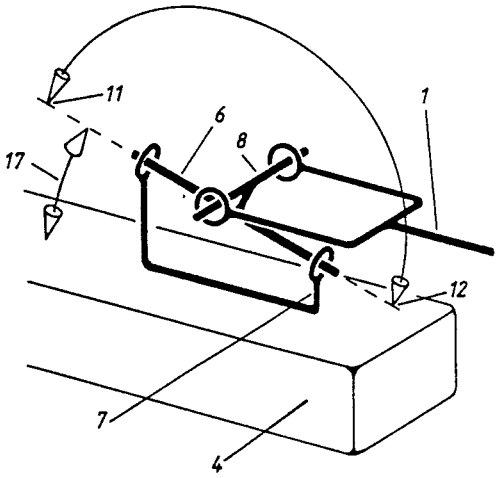
FIG. 4 shows a third embodiment of the present invention.

In the drawing, FIGS. 2, 3, and 4 show simple examples of the tiller extension hinge according to the invention. It will also be possible, however, to use other embodiments as it is the mutual placing of the axes of rotation and the placing thereof relative to the tiller and the tiller extension which together constitute the idea of the invention.

In FIG. 2, 6 is an axis resting in a bearing member 7 which is secured to the tiller 4 in such a manner that the axis 6 extends in a horizontal plane. Another axis 8 is fastened to the axis 6 at right angles thereto, said axis 8 by way of a bearing fork supporting the tiller extension 1. This allows the tiller extension 1 to move freely in a plane illustrated by the arrow 10 by rotating about the axis 8, this plane being rotatable about the axis 6 determined by the bearing member 7, as illustrated by the arrow 9. By combining the two rotations about the axes 6 and 8, it will be possible to make the tiller extension 1 assume any desired position, only downward limited by the tiller 4.

As a blocking of the tiller extension 1 will occur only when it is attempted to move this in a plane containing both axes 6 and 8 of the tiller extension hinge, it will be understood that such a blocking will take place only when the tiller extension 1 is in one of the positions indicated by 11 and 12, and it is possible constructively to avoid that the tiller extension 1 happens to get in any of these positions. On the whole, it is unnecessary to the steering of the boat that the tiller extension 1 is capable of being placed in or below a horizontal plane through the tiller extension hinge and in principle, it is thus without importance whether the axis 6 extends in a vertical plane through the tiller 4 or in a vertical plane forming an arbitrary angle with said tiller.

In practice, however, it may be advantageous that the axis 6 extends in a vertical plane through the tiller 4. The tiller extension hinge according to the invention may be considered as a universal joint in which the tiller extension 1 is the input axis, and the bearing member 7 firmly connected to the tiller 4, which is capable of rotating only in an in principle horizontal plane, represents the in principle vertical output axis.

It is known that it is characteristic of universal joints that when input and output axes form an angle, the angular velocity of these axes will vary relative to each other. FIG. 2 shows how this is utilized. In this Figure, 1*a* is the tiller extension 1 shown in a position pointing forward, which forms only a small angle 13 with the axis 6 and the tiller 4. In this position, a twisting of the tiller extension 1*a*, as indicated by the arrow 14, will cause only a little deflection of the tiller 4, as indicated by the arrow 15, which allows the helmsman to obtain the best control of the steering of the boat.

The mechanical construction of the tiller extension hinge may result in an undesirable limitation of the mobility of the tiller extension 1. FIG. 3 shows a way how to compensate for this. 16 is here a connection stud between the two axes 6 and 8 so that these cross each other without intersection. The stud 16 provides such a great distance between the elements of the tiller extension hinge that the physical extension thereof does not limit the functions of the hinge.

Another variation of the tiller extension hinge according to the invention is shown in FIG. 4. In this, the axis 6 having a firm position relative to the tiller 4, forms a small angle 17 with a horizontal plane. The positions 11 and 12 are thereby altered correspondingly, causing the position 12 to get under a horizontal plane through the tiller extension hinge which may be desirable since the helmsman will approach the tiller extension 1 to the position 12 more easily than to the position 11.

Furthermore, the inclination of the axis 6 results in good possibilities of fixing the tiller extension in the resting position thereof on top of the tiller 4, as it is possible to make the fork member of the tiller extension 1 fold down around the bearing member 7.

I claim:

1. A tiller extension hinge providing a universal joint between a normally horizontally disposed tiller and a tiller extension which is extendible from said tiller fore and aft of said hinge, said hinge comprising axis means for defining two pivot axes in a fixed position relative to each other, the position of one of said pivot axes being fixed relative to the tiller and the position of the other of said pivot axes being fixed relative to the tiller extension, said hinge being characterized in that the axis which has a position fixed relative to the tiller is oriented at a substantial angle from the vertical direction.

2. A tiller extension hinge according to claim 1, characterized in that said horizontally disposed tiller defines a line lying in a vertical plane and the axis which has a position fixed relative to the tiller also lies in said vertical plane.

3. A tiller extension hinge according to claim 1, characterized in that the two axes are displaced from each other so as to avoid intersection.

4. A tiller extension hinge according to claim 2, characterized in that the two axes are displaced from each other so as to avoid intersection.

5. A tiller extension hinge according to claim 1 in which said axis means includes a bearing fork connecting said tiller extension for pivoting movement about the axis which has its position fixed relative to said tiller extension.

6. A tiller extension hinge according to claim 1 in which said axis means includes a stud extending between said two pivot axes.

7. A tiller extension hinge according to claim 1 wherein the axis which has a position fixed relative to the tiller has its position determined by a bearing member secured to the tiller.

8. A tiller extension hinge according to claim 1 wherein said two pivot axis are in a fixed orthogonal position relative to each other.

* * * * *